US010851722B2

(12) United States Patent
Fukui et al.

(10) Patent No.: US 10,851,722 B2
(45) Date of Patent: Dec. 1, 2020

(54) EVAPORATED FUEL PROCESSING APPARATUS

(71) Applicant: AISAN KOGYO KABUSHIKI KAISHA, Obu (JP)

(72) Inventors: Keita Fukui, Fujinomiya (JP); Makoto Yamazaki, Gotemba (JP); Yoshikazu Miyabe, Obu (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 16/471,565

(22) PCT Filed: Nov. 22, 2017

(86) PCT No.: PCT/JP2017/042047
§ 371 (c)(1),
(2) Date: Jun. 20, 2019

(87) PCT Pub. No.: WO2018/116734
PCT Pub. Date: Jun. 28, 2018

(65) Prior Publication Data

US 2019/0390638 A1 Dec. 26, 2019

(30) Foreign Application Priority Data

Dec. 21, 2016 (JP) ..... 2016-248045

(51) Int. Cl.
*F02D 41/00* (2006.01)
*F02M 25/08* (2006.01)
*F02D 19/06* (2006.01)

(52) U.S. Cl.
CPC ..... *F02D 41/004* (2013.01); *F02D 19/0623* (2013.01); *F02D 41/003* (2013.01);
(Continued)

(58) Field of Classification Search
CPC ..... F02M 25/08; F02M 25/0836; F02M 25/0872; F02M 25/0809; F02D 19/0623;
(Continued)

(56) References Cited

U.S. PATENT DOCUMENTS

2014/0102420 A1 4/2014 Kimoto et al.
2015/0143996 A1* 5/2015 Kimoto ..... B01D 53/0454 96/114

(Continued)

FOREIGN PATENT DOCUMENTS

JP H02241963 A 9/1990
JP 2014077422 A 5/2014

(Continued)

*Primary Examiner* — Mahmoud Gimie
(74) *Attorney, Agent, or Firm* — Hunton Andrews Kurth LLP

(57) ABSTRACT

Both an improvement in detection accuracy of a valve opening position of a blocking valve and a reduction in time required for learning of the valve opening position are achieved. An evaporated fuel processing apparatus is provided with a learning device configured to learn the valve opening position of the blocking valve. The learning device learns the valve opening position (i) by stepwisely increasing a stroke amount by rotating a stepping motor by two steps at each time in a valve opening direction and (ii) by determining whether a difference between the stroke amount at present and the stroke amount corresponding to the valve opening position is one step of rotation of the stepping motor, or two steps, on the basis of pressure fluctuation on the canister side of the blocking valve associated with the rotation of the stepping motor when the blocking valve is opened, when learning the valve opening position.

1 Claim, 4 Drawing Sheets

(52) U.S. Cl.
CPC ..... *F02D 41/0032* (2013.01); *F02D 41/0037* (2013.01); *F02M 25/08* (2013.01); *F02M 25/0836* (2013.01); *F02M 25/0872* (2013.01)

(58) Field of Classification Search
CPC .. F02D 41/003; F02D 41/0032; F02D 41/004; F02D 41/0037
USPC ..... 123/457, 516, 518–520
See application file for complete search history.

(56) References Cited

U.S. PATENT DOCUMENTS

| | | | | |
|---|---|---|---|---|
| 2015/0144111 | A1 | 5/2015 | Akita et al. | |
| 2015/0159566 | A1* | 6/2015 | Akita | F02D 41/003 137/488 |
| 2015/0159568 | A1 | 6/2015 | Tagawa et al. | |
| 2015/0159598 | A1* | 6/2015 | Tagawa | F02M 25/0854 123/520 |
| 2015/0330338 | A1* | 11/2015 | Ito | F02M 25/0836 123/520 |
| 2016/0356227 | A1 | 12/2016 | Akita et al. | |
| 2017/0284321 | A1 | 10/2017 | Kimoto et al. | |

FOREIGN PATENT DOCUMENTS

| | | | |
|---|---|---|---|
| JP | 2015102020 | A | 6/2015 |
| JP | 2015110914 | A | 6/2015 |
| JP | 2015110916 | A | 6/2015 |
| JP | 2016050540 | A | 4/2016 |
| WO | 2015/076027 | A1 | 5/2015 |
| WO | 2016/035657 | A1 | 3/2016 |

* cited by examiner

EVAPORATED FUEL PROCESSING APPARATUS

CROSS-REFERENCE TO RELATED APPLICATIONS

This application is a national phase application based on International Patent Application No. PCT/JP2017/042047 filed Nov. 22, 2017, claiming priority to Japanese Patent Application No. 2016-248045 filed Dec. 21, 2016, the entire contents of which both are incorporated herein by reference.

TECHNICAL FIELD

The present invention relates to an evaporated fuel processing apparatus configured to process evaporated fuel generated in a fuel tank.

BACKGROUND ART

For this type of apparatus, for example, there is proposed an apparatus provided with: a canister containing adsorbent for adsorbing evaporated fuel generated in a fuel tank; and a blocking valve with a stepping motor disposed in a vapor passage, which connects the canister and the fuel tank (refer to Patent Literature 1). The Patent Literature 1 discloses the following matter. When a valve opening start position of the blocking valve is learned, the following processes are repeated; namely, rotating a stepping motor A-steps in a valve opening direction, rotating it B-steps in a valve closing direction, and detecting tank inner pressure. If the tank inner pressure currently detected is less than a previously detected value by a predetermined value or more, then, it is determined that the valve opening of the blocking valve is started.

CITATION LIST

Patent Literature

Patent Literature 1: WO 2015/076027

SUMMARY OF INVENTION

Technical Problem

A rotation amount (or a rotation angle) of the stepping motor is controlled by a step unit. It can be said that the valve opening start position detected while rotating the stepping motor by one step at each time in the valve opening direction when learning the valve opening start position of the blocking valve, is the valve opening start position with the best detection accuracy. Here, the number of steps per rotation associated with the specification of the stepping motor, in other words, the rotation angle per step, is not considered. The stepping motor, however, rotates only by one step at each time in the valve opening direction, and thus, it takes a relatively long time to learn the valve opening start position. In contrast, if the valve opening start position is detected while rotating the stepping motor by two or more steps at each time in the valve opening direction so as to reduce the time required for the learning of the valve opening start position, then, the detection accuracy is reduced. In the technology/technique described in the Patent Literature 1, it is hardly possible to achieve both an improvement in the detection accuracy of the valve opening start position and a reduction in the time required for the learning of the valve opening start position.

In view of the aforementioned problems, it is therefore an object of embodiments of the present invention to provide an evaporated fuel processing apparatus that can achieve both the improvement in the detection accuracy of the valve opening start position and the reduction in the time required for the learning of the valve opening start position.

Solution to Problem

The above object of the present invention can be achieved by an evaporated fuel processing apparatus including: a canister containing adsorbent for adsorbing evaporated fuel generated in a fuel tank; a vapor passage connecting the canister and the fuel tank; and a blocking valve, which is disposed in the vapor passage, which is closed when a stroke amount is less than a predetermined amount, and which is opened when the stroke amount is greater than or equal to the predetermined amount, wherein the blocking valve has a stepping motor configured to adjust the stroke amount, the evaporated fuel processing apparatus comprises a learning device configured to learn a valve opening position of the blocking valve, and the learning device is configured to learn the valve opening position (i) by stepwisely increasing the stroke amount by rotating the stepping motor by two steps at each time in a valve opening direction and (ii) by determining whether a difference between the stroke amount at present and the stroke amount corresponding to the valve opening position is one step of rotation of the stepping motor, or two steps, on the basis of pressure fluctuation on the canister side of the blocking valve associated with the rotation of the stepping motor when the blocking valve is opened, when learning the valve opening position.

On the evaporated fuel processing apparatus, when learning the valve opening position (corresponding to the aforementioned "valve opening start position"), the stepping motor is rotated by two steps at each time in the valve opening direction. Thus, according to the evaporated fuel processing apparatus, it is possible to reduce the time required for the learning, in comparison with when the stepping motor is rotated by one step at each time in the valve opening direction in the learning.

Particularly on the evaporated fuel processing apparatus, it is determined whether the pressure fluctuation on the canister side of the blocking valve when the blocking valve is opened, corresponds to the pressure fluctuation corresponding to one step of the steeping motor, or the pressure fluctuation corresponding to two steps. Thus, according to the evaporated fuel processing apparatus, it is possible to learn the valve opening position by one step of the stepping motor at each time.

Therefore, according to the evaporated fuel processing apparatus, it is possible to achieve both the improvement in the detection accuracy of the valve opening position and the reduction in the time required for the learning of the valve opening position. The "valve opening position" according to the present invention may mean a position that allows the blocking valve to be opened if the stroke amount increases even slightly from that position.

The effect and other advantages of the present invention will become apparent from the embodiment explained below.

DESCRIPTION OF EMBODIMENTS

An evaporated fuel processing apparatus according to the present invention will be explained with reference to FIG. 1 to FIG. 4B.

(Entire Configuration)

Figure 1:
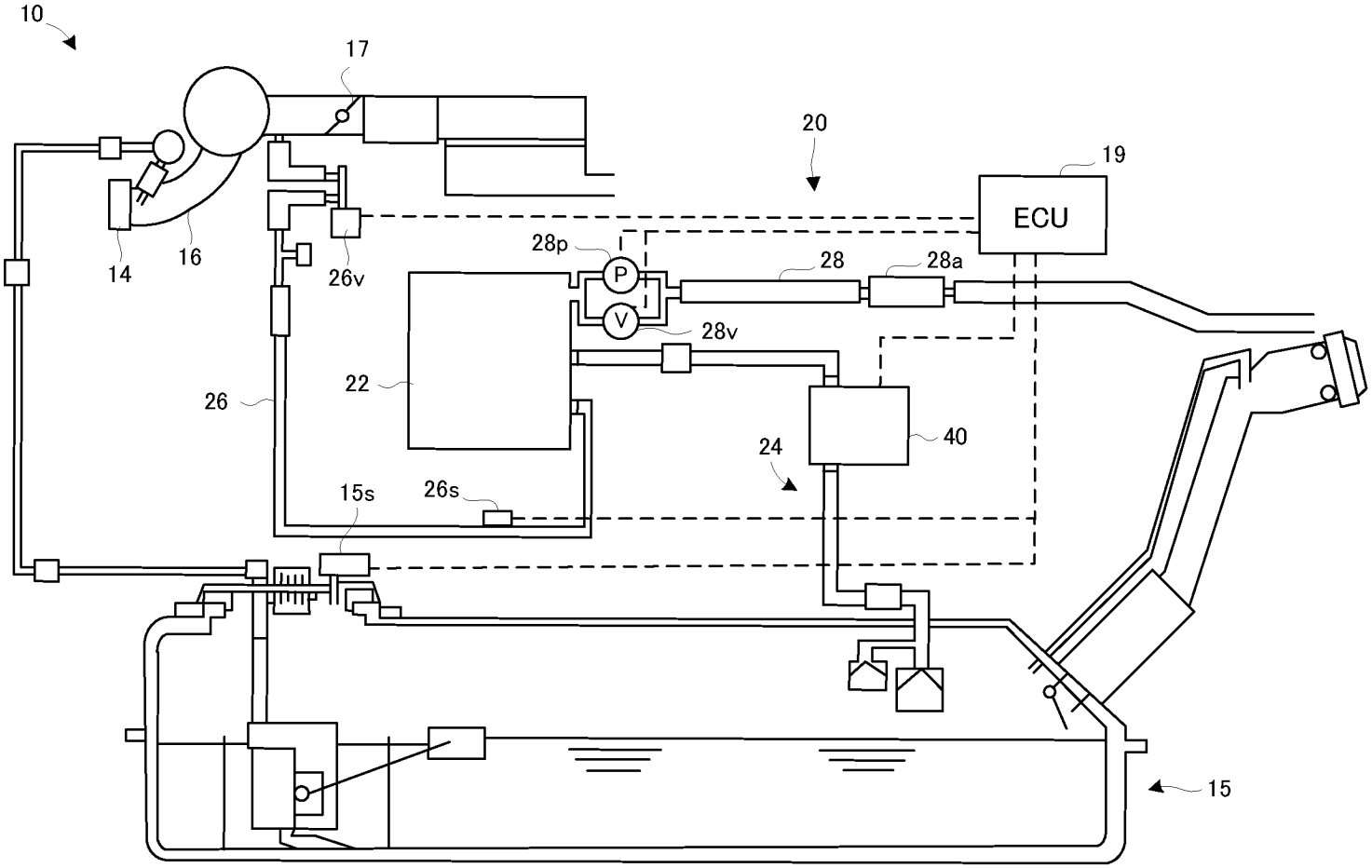
FIG. 1 is an entire block diagram illustrating an evaporated fuel processing apparatus according to an embodiment.

A configuration of the evaporated fuel processing apparatus according to the embodiment will be explained with reference to FIG. 1. FIG. 1 is an entire block diagram illustrating the evaporated fuel processing apparatus according to the embodiment.

In FIG. 1, an evaporated fuel processing apparatus 20 is provided in an engine system 10 of a not-illustrated vehicle, and is configured to prevent that evaporated fuel generated in a fuel tank 15 of the vehicle leaks out.

The evaporated fuel processing apparatus 20 is provided with a canister 22, a vapor passage 24, a purge passage 26, and an atmospheric air passage 28. The canister 22 is filled with activated carbon as adsorbent. The canister 22 is configured to adsorb the evaporated fuel in the fuel tank 15 by using the adsorbent. The vapor passage 24 is communicated, at one end, with a gas layer part in the fuel tank 15, and is communicated, at the other end, with the canister 22. The vapor passage 24 is provided with a blocking valve 40 configured to switch between communication and shutoff in the vapor passage 24. The purge passage 26 is communicated, at one end, with the canister 22, and is communicated, at the other end, with a downstream side of a throttle valve 17 in an intake passage 16 of an engine 14. The purge passage 26 is provided with a purge valve 26*v* configured to switch between communication and shutoff in the purge passage 26.

The canister 22 is communicated with the atmospheric air passage 28 with a tip opened to the atmosphere. The atmospheric air passage 28 is provided with an air filter 28*a*. The atmospheric air passage 28 is also provided with a switching valve 28*v* configured to switch between communication and shutoff in the atmospheric air passage 28, wherein the switching valve 28*v* is disposed nearer to the canister 22 than the air filter 28*a*. The switching valve 28*v* includes, for example, a normally open solenoid valve, which is open when the solenoid is not energized. The atmospheric air passage 28 is also provided with a pump 28*p* configured to forcibly feed an atmospheric air to the canister 22, wherein the pump 28*p* is parallel to the blocking valve 28*b*. The pump 28*p* may be of any type as long as it can pressurize an inside of a system including the canister 22 and the fuel tank 15, but is preferably configured not to generate a gas flow in an OFF state.

The blocking valve 40, the purge valve 26*v*, the switching valve 28*v*, and the pump 28*p* are controlled on the basis of signals from an electronic control unit (ECU) 19. In other words, in the embodiment, a part of functions of the ECU 19 for various electronic controls of the vehicle is used as a part of the evaporated fuel processing apparatus 20.

The evaporated fuel processing apparatus 20 is provided with: a tank pressure sensor 15*s* disposed in the fuel tank 15; and an evaporation system pressure sensor (hereinafter referred to as a "system pressure sensor") 26*s* disposed nearer to the canister 22 than the purge valve 26 in the purge passage 26, as pressure sensors configured to detect pressure in the system. The tank pressure sensor 15*s* is configured to detect pressure of an area on the side of the fuel tank 15 out of two areas into which the system is separated by the blocking valve 40. The system pressure sensor 26*s* is configured to detect pressure of an area including the canister 22 (or specifically, an area into which the system is partitioned by the purge valve 26*v*, the switching valve 26*v*, and the blocking valve 40) (hereinafter referred to as "system pressure") out of two areas into which the system is separated by the blocking valve 40. The ECU 19 is configured to receive signals from the tank pressure sensor 15*s* and the system pressure sensor 26*s*.

(Overview of Operation of Evaporated Fuel Processing Apparatus)

Next, an overview of operation of the evaporated fuel processing apparatus 20 configured in the above manner will be explained. By the control of the ECU 19, the purge valve 26*v* is appropriately opened if a predetermined purge condition is satisfied during running of the vehicle. At this time, the switching valve 28*v* is open, and the atmospheric air thus flows in from the atmospheric air passage 28 due to intake negative pressure of the engine 14. The evaporated fuel purged from the adsorbent of the canister 22 by the atmospheric air is introduced into an intake passage 17 of the engine 14 via the purge valve 26*v*. The ECU 19 is also configured to open the blocking valve 40 and to perform a pressure relief control of the fuel tank 15 if the pressure of the fuel tank 15 detected by the tank pressure sensor 15*s* is greater than a predetermined pressure. Various existing aspects can be applied to the control associated with the purge of the evaporated fuel adsorbed on the adsorbent of the canister 22, and the pressure relief control of the fuel tank 15. An explanation of the details of the controls will be thus omitted.

(Configuration of Blocking Valve)

Figure 2:
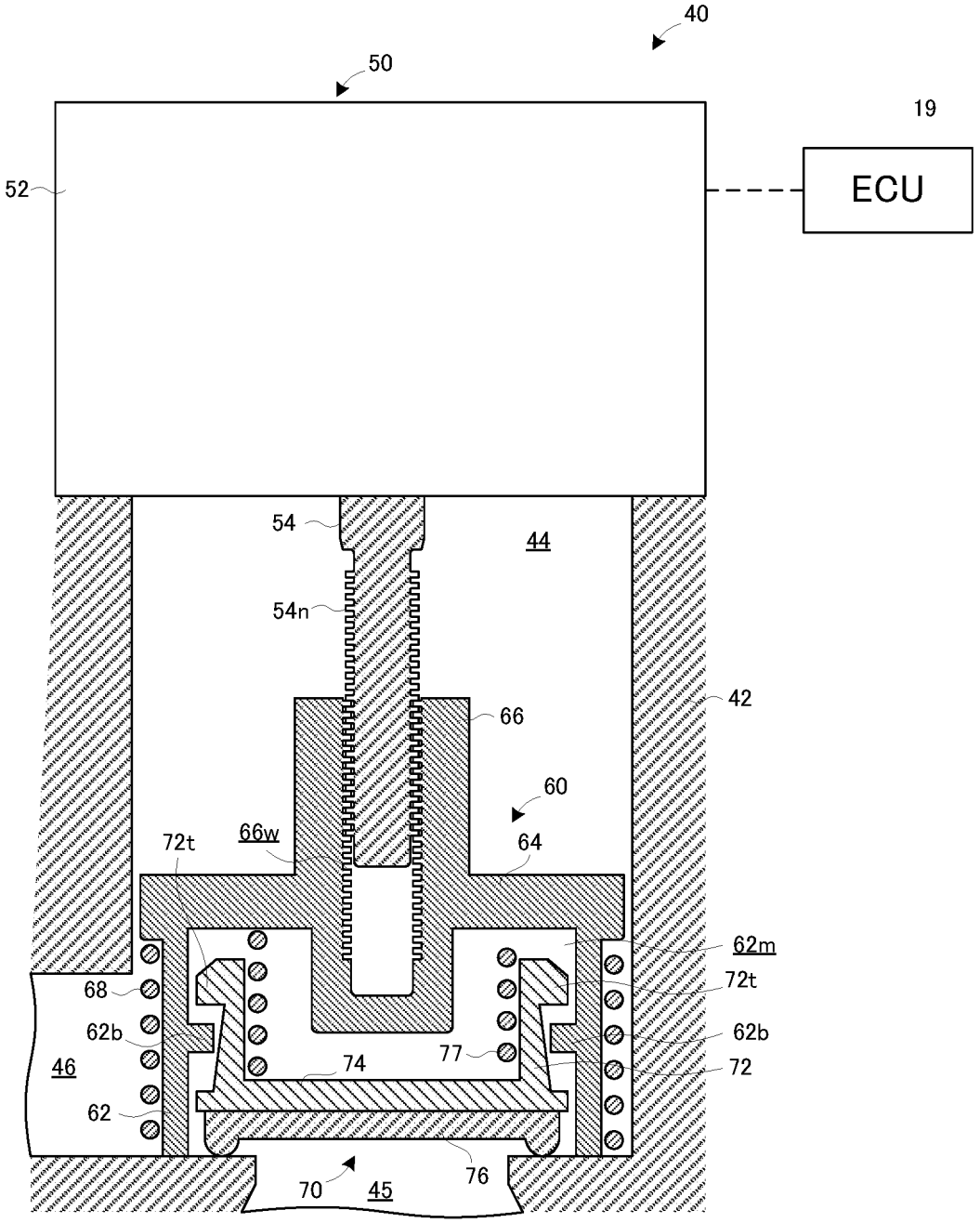
FIG. 2 is a longitudinal sectional view illustrating a state of a blocking valve according to the embodiment.

A configuration of the blocking valve 40 will be explained with reference to FIG. 2. FIG. 2 is a longitudinal sectional view illustrating a state of the blocking valve according to the embodiment.

The blocking valve 40 is a flow control valve for blocking the vapor passage 24 in a valve open state and controlling a flow rate or a flow volume of a gas that flows in the vapor passage 24 in the valve open state. In FIG. 2, the blocking valve 40 is provided with a valve casing 42, a stepping motor 50, a valve guide 60, and a valve body 70. The valve casing 42 is provided with a valve chamber 44, an inlet passage 45, and an outlet passage 46. The valve chamber 44, the inlet passage 45, and the outlet passage 46 constitute a fluid passage.

The stepping motor 50 is mounted on an upper part of the valve casing 42. The stepping motor 50 has: a motor body 52; and an output shaft 54, which protrudes from a lower surface of the motor body 52 and which is configured to rotate in forward and reverse directions. The output shaft 54 is concentrically disposed in the valve chamber 44 of the valve casing 42, and a male screw 54*n* is formed on an outer peripheral surface of the output shaft 54.

The valve guide 60 is provided with a cylindrical wall 62 and an upper wall 64 configured to close an upper end opening of the cylindrical wall 62, and is formed in a topped cylindrical shape. A cylindrical shaft 66 is concentrically formed in a central part of the upper wall 64. A female screw 66*w* is formed on an inner peripheral surface of the cylindrical shaft 66. The valve guide 60 is movably disposed in an axial direction (or vertical direction), while rotation around the axial direction is stopped by a not-illustrated detent or rotation stopper, with respect to the valve casing 42.

The male screw 54*n* of the output shaft 54 of the stepping motor 50 is screwed into the female screw 66*w* of the cylindrical shaft 66 of the valve guide 60. This makes it possible for the valve guide 60 to move up and down in the axial direction on the basis of the forward and reverse rotation of the output shaft 54 of the stepping motor 50. Around the valve guide 60, there is provided an auxiliary spring 68 configured to bias the valve guide 60 upward.

The valve body 70 is provided with a cylindrical wall 72 and a lower wall 74 configured to close a lower end opening of the cylindrical wall 72, and is formed in a bottomed cylindrical shape. On a lower surface of the lower wall 74, for example, there is disposed a seal member 76 made of a disk-shaped rubber elastic material. The valve body 70 is concentrically disposed in the valve guide 60. The seal member 76 of the valve body 70 is disposed to abut on an upper surface of a valve seat of the valve casing 42 (near an end on the side of the valve chamber 44 in the inlet passage 45).

On an outer peripheral surface of the cylindrical wall 72 of the valve body 70, a plurality of coupling protrusions 72*t* are formed in a circumferential direction. The coupling protrusions 72*t* of the valve body 70 are fit in vertically-grooved coupling recesses 62*m* formed in an inner peripheral surface of the cylindrical wall 62 of the valve guide 60, to be relatively movable in the vertical direction by a fixed dimension. The valve guide 60 and the valve body 70 are configured to integrally move upward (i.e. in a valve opening direction) while bottom walls 62*b* of the coupling recesses 62*m* of the valve guide 60 abut on the coupling protrusions 72*t* of the valve body 70 from below. Between the upper wall 64 of the valve guide 60 and the lower wall 74 of the valve body 70, there is concentrically provided a valve spring 77 configured to bias the valve body 70 always downward (i.e. in a valve closing direction) with respect to the valve guide 60.

(Operation of Blocking Valve)

Next, operation of the blocking valve 40 as configured above will be explained. The blocking valve 40 is configured to rotate the stepping motor 50 with the predetermined number of steps (hereinafter referred to as the predetermined step number) in the valve opening direction or the valve closing direction on the basis of the signals from the ECU 19. As a result, due to screwing action of the male screw 54*n* of the output shaft 54 of the stepping motor 50 and the female screw 66*w* of the cylindrical shaft 66 of the valve guide 60, the valve guide 60 may move by a predetermined stroke amount in the vertical direction.

In an initial state of the blocking valve 40, the valve guide 60 is held at a lower limit position, and a lower end face of the cylindrical wall 62 abuts on the upper surface of the valve seat of the valve casing 42. In this state, the coupling protrusions 72*t* of the valve body 70 are located above the bottom walls 62*b* of the coupling recesses 62*m* of the valve guide 60 (refer to FIG. 2), and the seal member 76 of the valve body 70 is pressed to the upper surface of the valve seat of the valve casing 42 by spring force of the valve spring 77.

When the stepping motor 50 is rotated in the valve opening direction from the initial state of the blocking valve 40, the valve guide 60 moves upward due to the screwing action of the male screw 54*n* and the female screw 66*w*, and the bottom walls 62*b* of the coupling recesses 62*m* of the valve guide 60 abut on the coupling protrusions 72*t* of the valve body 70 from below. Then, when the stepping motor 50 is further rotated in the valve opening direction and the valve guide 60 further moves upward, the valve body 70 moves upward with the valve guide 60, and the seal member 76 of the valve body 70 leaves the valve seat of the valve casing 42. As a result, the blocking valve 40 is opened.

(Learning of Valve Opening Position of Blocking Valve)

The valve opening position of the blocking valve 40 varies depending on the blocking valve 40, for example, due to position tolerance of the coupling protrusions 72*t* formed on the valve body 70, position tolerance of the bottom walls 62*b* formed on the coupling recesses 62*m* of the valve guide 60, or the like. Therefore, a learning control for leaning the valve opening position of the blocking valve 40 is performed on the evaporated fuel processing apparatus 20. The learning control according to the embodiment will be explained with reference to FIG. 3 to FIG. 4B.

Figure 3:
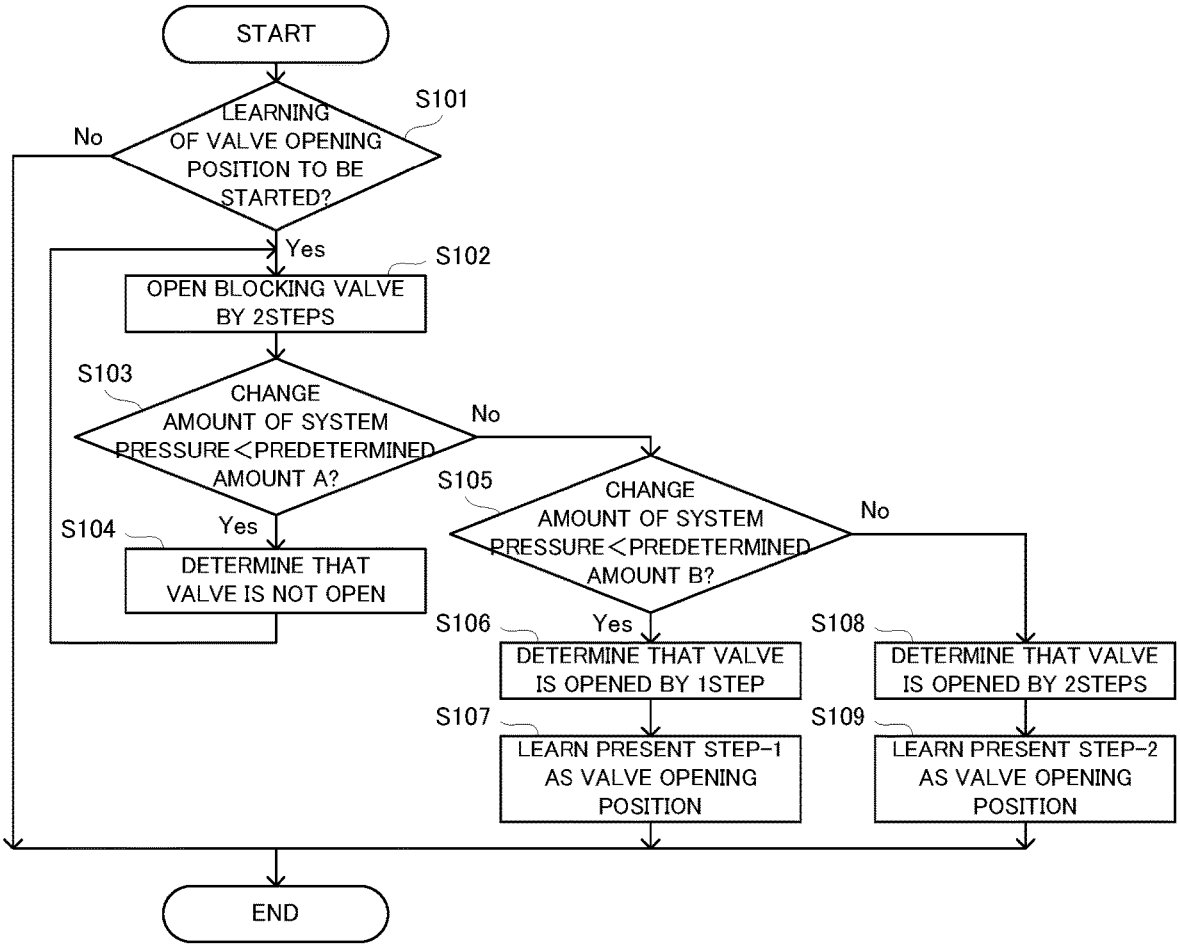
FIG. 3 is a flowchart illustrating a learning control associated with learning of a valve opening position of the blocking valve according to the embodiment.

In FIG. 3, the ECU 19, which is a part of the evaporated fuel processing apparatus 20, determines whether or not the learning of the valve opening position of the blocking valve 40 is to be started (step S101). The "ECU 19" according to the embodiment is an example of the "learning device" according to the present invention.

Here, the ECU 19 determines that the learning of the valve opening position of the blocking valve 40 is to be started if, after the start of the engine 14, the engine 14 is in an operating state in which the evaporated fuel adsorbed on the adsorbent of the canister 22 can be purged and in which the pressure of the fuel tank 15 is positive. If the valve opening position of the blocking valve 40 is once learned after ignition-on, it is not necessary to learn the valve opening position until next ignition-on after ignition-off. The ECU 19 thus determines that the learning of the valve opening position of the blocking valve 40 is not to be started if there is a learning history of the valve opening position after the present ignition-on.

In the determination in the step S101, if it is determined that the learning of the valve opening position of the blocking valve 40 is not to be started (the step S101: No), the process is ended. Then, the ECU 19 performs the step S101 again after a lapse of a predetermined time.

On the other hand, in the determination in the step S101, if it is determined that the learning of the valve opening position of the blocking valve 40 is to be started (the step S101: Yes), the ECU 19 rotates the stepping motor 50 up to the predetermined step number in the valve opening direction or in the valve closing direction. The "predetermined step number" is not necessarily limited to 0 steps (i.e., in the initial state), but may be appropriately set in a range of the step number in which the blocking valve 40 is closed. If the predetermined step number is set to be greater than 0 steps, the step number is reduced from the predetermined step number to a step number corresponding to the valve opening position. It is thus possible to end the learning of the valve opening position at a relatively early stage. The ECU 19 further closes the switching valve 28*v* and shuts off the atmospheric air passage 28. The ECU 19 maintains a valve closed state of the purge valve 26*v*.

The ECU 19 then rotates the stepping motor 50 by two steps in the valve opening direction (step S102). The ECU 19 then determines whether or not a change amount of the system pressure between before and after the step S102 is performed (which, in other words, is caused by the rotation of the stepping motor 50 by two steps in the valve opening direction), is less than a predetermined value A, on the basis of signals from the system pressure sensor 26*s* (step S103).

Here, the change amount of the system pressure being less than the predetermined value A, may mean that the blocking valve 40 maintains the valve closed state. On the other hand, the change amount of the system pressure being greater than or equal to the predetermined value A, may mean that the blocking valve 40 is opened. The "predetermined value A" may be simply "0", but is preferably set to a value that is slightly greater than 0, in view of a detection error of the system pressure sensor 26*s*, a variation in the system pressure caused, for example, by a volume change of the canister 22 due to environmental temperature, or the like.

In the determination in the step S103, if it is determined that the change amount of the system pressure is less than the predetermined value A (the step S103: Yes), the ECU 19 determines that the blocking valve 40 is not opened (step S104), and performs the step S102.

On the other hand, in the determination in the step S103, if it is determined that the change amount of the system pressure is greater than or equal to the predetermined value A (the step S103: No), the ECU 19 determines whether or not the change amount of the system pressure is less than a predetermined value B (step S105). The predetermined value B is greater than the predetermined value A.

In the control, a process of rotating the stepping motor 50 by two steps in the valve opening direction, i.e., the step S102, and a process of determining whether or not the change amount of the system pressure is less than the predetermined value A, i.e., the step S103, are repeated until it is determined that the change amount of the system pressure is greater than or equal to the predetermined value A. Thus, if no measures are taken, the valve opening position of the blocking valve 40 is learned only by two steps. In other words, the resolution of the valve opening position is two steps.

By the way, cases where the change amount of the system pressure is greater than or equal to the predetermined value A (i.e., the blocking valve 40 is opened) include: (i) a case where the seal member 76 of the valve body 70 leaves the valve seat of the valve casing 42 by a stroke amount corresponding to one step of the stepping motor 50; and (ii) a case where the seal member 76 leaves the valve seat by a stroke amount corresponding to two steps of the stepping motor 50. The present inventors have focused on this point, and have configured the evaporated fuel processing apparatus 20 to determine whether it is a change amount corresponding to one step of the stepping motor 50 or a change amount corresponding to two steps, from the change amount of the system pressure when the blocking valve 40 is opened.

On the basis of the above idea, the "predetermined value B" according to the embodiment may be set as a value with which it is surely possible to distinguish between the change amount of the system pressure when the seal member 76 leaves the valve seat by the stroke amount corresponding to one step of the stepping motor 50 and the change amount of the system pressure when the seal member 76 leaves the valve seat by the stroke amount corresponding to two steps of the stepping motor 50. Specifically, the predetermined value B may be set as a value between the change amount of the system pressure when the seal member 76 leaves the valve seat by the stroke amount corresponding to one step of the stepping motor 50 and the change amount of the system pressure when the seal member 76 leaves the valve seat by the stroke amount corresponding to two steps of the stepping motor 50.

In the determination in the step S105, if it is determined that the change amount of the system pressure is less than the predetermined value B (the step S105: Yes), the ECU 19 determines that the blocking valve 40 is opened while the seal member 76 leaves the valve seat by the stroke amount corresponding to one step of the stepping motor 50 (step S106), and learns a value obtained by subtracting "1" from the present step number, as the valve opening position (step S107).

On the other hand, in the determination in the step S105, if it is determined that the change amount of the system pressure is greater than or equal to the predetermined value B (the step S105: No), the ECU 19 determines that the blocking valve 40 is opened while the seal member 76 leaves the valve seat by the stroke amount corresponding to two steps of the stepping motor 50 (step S108), and learns a value obtained by subtracting "2" from the present step number, as the valve opening position (step S109).

Next, with reference to FIG. 4A and FIG. 4B, an explanation will be given to time variation of the step number of the stepping motor 50 and the like when learning the valve opening position of the blocking valve 40.

Figure 4A:
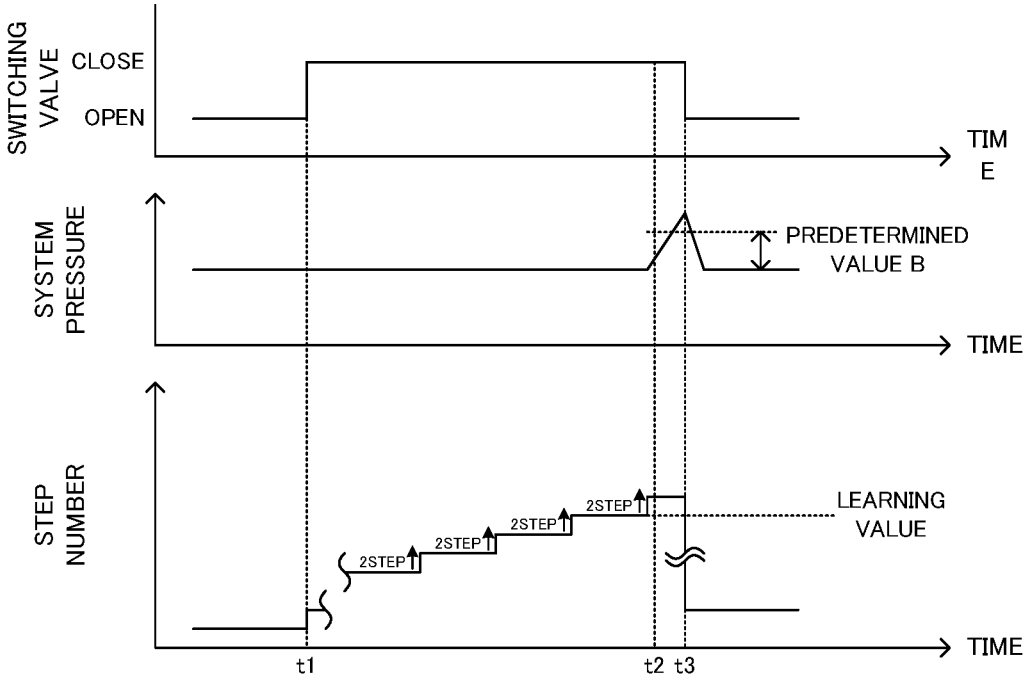
FIG. 4A and FIG. 4B are conceptual diagrams illustrating a concept of time variation of system pressure and a concept of time variation of the number of steps of a stepping motor, in the learning control according to the embodiment.

Suppose that at a time point t1 in FIG. 4A, it is determined that the learning of the valve opening position of the blocking valve 40 is started, in the determination in the step S101. As a result, the ECU 19 energizes and closes the switching valve 28*v*. Until the switching valve 28 is closed, the purge valve 26*v* and the blocking valve 40 are closed, and the atmospheric air passage 28 is communicated. Thus, an initial value of the system pressure is the atmospheric pressure.

The ECU 19 then repeats the process of rotating the stepping motor 50 by two steps in the valve opening direction, i.e., the step S102, and the process of determining whether or not the change amount of the system pressure is less than the predetermined value A, i.e., the step S103, until it is determined that the change amount of the system pressure is greater than or equal to the predetermined value A.

Suppose that at a time point t2, it is determined that the change amount of the system pressure is greater than or equal to the predetermined value A in the determination in the step S103, and that at a time point t3, it is determined that the change amount of the system pressure is greater than or equal to the predetermined value B in the determination in the step S105. As a result, the ECU 19 learns a value obtained by subtracting "2" from the present step number, as the valve opening position (the step S109). The ECU 19 then rotates the stepping motor 50 up to the predetermined step number in the valve closing direction, to close the blocking valve 40 and to open the switching valve 28*v*.

Figure 4B:
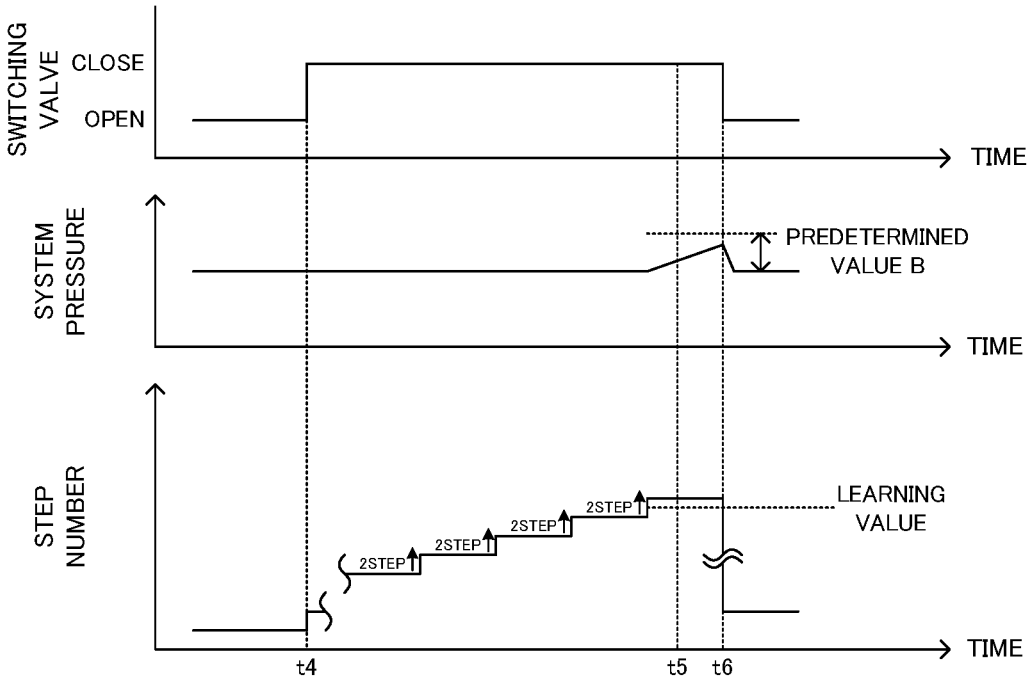

In the same manner, suppose that at a time point t3 in FIG. 4B, it is determined that the learning of the valve opening position of the blocking valve 40 is started, in the determination in the step S101. As a result, the ECU 19 energizes and closes the switching valve 28*v*.

The ECU 19 then repeats the process of rotating the stepping motor 50 by two steps in the valve opening direction, i.e., the step S102, and the process of determining whether or not the change amount of the system pressure is less than the predetermined value A, i.e., the step S103, until it is determined that the change amount of the system pressure is greater than or equal to the predetermined value A.

Suppose that at a time point t4 it is determined that the change amount of the system pressure is greater than or equal to the predetermined value A in the determination in the step S103, and that at a time point t5, it is determined that the change amount of the system pressure is less than the predetermined value B in the determination in the step S105. As a result, the ECU 19 learns a value obtained by subtracting "1" from the present step number, as the valve opening position (the step S107). The ECU 19 then rotates the stepping motor 50 up to the predetermined step number in the valve closing direction, to close the blocking valve 40 and to open the switching valve 28*v*.

(Technical Effect)

On the evaporated fuel processing apparatus 20, when learning the valve opening position of the blocking valve 40, the stepping motor 40 is rotated by two steps at each time in the valve opening direction. It is thus possible to reduce the time required for the learning, in comparison with when the stepping motor 50 is rotated by one step at each time in the valve opening direction in the learning.

In addition, on the evaporated fuel processing apparatus 20, it is determined whether the seal member 76 of the valve body 70 leaves the valve seat of the valve casing 42 by the stroke amount corresponding to one step of the stepping motor 50 or by the stroke amount corresponding to two steps, by determining whether or not the change amount of the system pressure when the blocking valve 40 is opened (i.e., when it is determined that the change amount of the system pressure is greater than or equal to the predetermined value A) is less than the predetermined value B. Thus, when learning the valve opening position of the blocking valve 40, the stepping motor 50 is rotated by two steps at each time in the valve opening direction, but the valve opening position is learned by one step at each time.

Therefore, according to the evaporated fuel processing apparatus 20, it is possible to improve the detection accuracy of the valve opening position while reducing the time required for the learning of the valve opening position of the blocking valve 40.

Modified Example

If the system pressure sensor 26*s* allows, for example, accurate determination of (i) the change amount of the system pressure when the seal member 76 of the valve body 70 leaves the valve seat of the valve casing 42 by the stroke amount corresponding to one step of the stepping motor 50, (ii) the change amount of the system pressure when the seal member 76 leaves the valve seat by the stroke amount corresponding to two steps of the stepping motor 50, and (iii) the change amount of the system pressure when the seal member 76 leaves the valve seat by a stroke amount corresponding to three steps of the stepping motor 50, then, the stepping motor 50 may be rotated by three steps (or by four or more steps) at each time in the valve opening direction when learning the valve opening position of the blocking valve 40.

The present invention is not limited to the aforementioned embodiment and example, but various changes may be made, if desired, without departing from the essence or spirit of the invention which can be read from the claims and the entire specification. A evaporated fuel processing apparatus that involves such changes is also intended to be within the technical scope of the present invention.

DESCRIPTION OF REFERENCE NUMERALS AND LETTERS

10 engine system
15 fuel tank
19 ECU
20 evaporated fuel processing apparatus
22 canister
24 vapor passage
26 purge passage
26*s* evaporation system pressure sensor
26*v* purge valve
28 atmosphere air passage
28*v* switching valve
40 blocking valve
50 stepping motor

The invention claimed is:

1. An evaporated fuel processing apparatus including: a canister containing adsorbent for adsorbing evaporated fuel generated in a fuel tank; a vapor passage connecting the canister and the fuel tank; and a blocking valve, which is disposed in the vapor passage, which is closed when a stroke amount is less than a predetermined amount, and which is opened when the stroke amount is greater than or equal to the predetermined amount, wherein the blocking valve has a stepping motor configured to adjust the stroke amount, said evaporated fuel processing apparatus comprises a learning device configured to learn a valve opening position of the blocking valve, and said learning device is configured to learn the valve opening position (i) by stepwisely increasing the stroke amount by rotating the stepping motor by two steps at each time in a valve opening direction and (ii) by determining whether a difference between the stroke amount at present and the stroke amount corresponding to the valve opening position is one step of rotation of the stepping motor, or two steps, on the basis of pressure fluctuation on the canister side of the blocking valve associated with the rotation of the stepping motor when the blocking valve is opened, when learning the valve opening position.

* * * * *